US008346106B2

(12) United States Patent
Takenaka et al.

(10) Patent No.: US 8,346,106 B2
(45) Date of Patent: Jan. 1, 2013

(54) FIXING DEVICE AND IMAGE FORMING APPARATUS USING SAME HAVING A SECOND HEATER OUTSIDE THE RECORDING MEDIUM PASSING AREA

(75) Inventors: Kohta Takenaka, Yokohama (JP); Kazunori Bannai, Atsugi (JP); Hidehiko Fujiwara, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 105 days.

(21) Appl. No.: 12/843,299

(22) Filed: Jul. 26, 2010

(65) Prior Publication Data

US 2011/0020018 A1 Jan. 27, 2011

(30) Foreign Application Priority Data

Jul. 27, 2009 (JP) ..... 2009-174219

(51) Int. Cl.
*G03G 15/20* (2006.01)

(52) U.S. Cl. ..... 399/33; 399/67

(58) Field of Classification Search ..... 399/33, 399/67, 69, 320, 324, 336
See application file for complete search history.

(56) References Cited

U.S. PATENT DOCUMENTS

| | | | | |
|---|---|---|---|---|
| 5,774,763 | A * | 6/1998 | Muramatsu | 399/69 |
| 2008/0279576 | A1* | 11/2008 | Kim et al. | 399/69 |
| 2009/0116884 | A1* | 5/2009 | Nonaka et al. | 399/328 |
| 2010/0246246 | A1 | 9/2010 | Kim et al. | |

FOREIGN PATENT DOCUMENTS

| | | | |
|---|---|---|---|
| JP | 9-185984 | | 7/1997 |
| JP | 2002-6656 | | 1/2002 |
| JP | 2004012823 | A * | 1/2004 |
| JP | 2007-58119 | | 3/2007 |
| JP | 3986264 | | 7/2007 |
| JP | 2008-40420 | | 2/2008 |

OTHER PUBLICATIONS

U.S. Appl. No. 12/837,917, filed Jul. 16, 2010, Ohta et al.

* cited by examiner

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

A fixing device includes a fixing member including a recording medium passing area inside thereof through which the recording medium passes, a first heater disposed in the fixing member to heat the fixing member, a first pressing member disposed opposite the fixing member to press against and rotate the fixing member to fix the unfixed toner image on the recording medium, a second heater disposed outside the recording medium passing area and inside the fixing member to heat the fixing member cyclically in a given cycle of heating, a temperature detector to detect a change in the temperature of the fixing member when the fixing member is cyclically heated by the second heater, and a determination unit to evaluate a condition of rotation of the fixing member based on the cycle of heating by the second heater and the cycle of change in the temperature detected by the temperature detector.

13 Claims, 7 Drawing Sheets

FIXING DEVICE AND IMAGE FORMING APPARATUS USING SAME HAVING A SECOND HEATER OUTSIDE THE RECORDING MEDIUM PASSING AREA

CROSS-REFERENCE TO RELATED APPLICATIONS

This patent application is based on and claims priority pursuant to 35 U.S.C. §119 from Japanese Patent Application No. 2009-174219. filed on Jul. 27, 2009 in the Japan Patent Office, which is hereby incorporated herein by reference in its entirety.

BACKGROUND OF THE INVENTION

1. Field of the Invention

Exemplary aspects of the present invention generally relate to a fixing device and an image forming apparatus including the same, and more particularly, to a fixing device that fixes an unfixed toner image on a recording medium by applying heat and pressure thereto, and an image forming apparatus including the fixing device.

2. Description of the Background Art

Typically, a fixing device for fixing an unfixed toner image onto a recording medium is equipped with a roller-type fixing member (hereinafter referred to as fixing roller), a roller-type pressing member (hereinafter referred to as pressure roller), and a halogen heater serving as a heating member. The fixing roller is generally hollow and accommodates the halogen heater inside thereof. Supplying electric power to the halogen heater heats the fixing roller. The pressure roller is pressed against the fixing roller by an urging member.

Such a fixing device is provided with a temperature detector to detect the temperature of the surface of the fixing roller. An output of the temperature detector is provided to a temperature controller that controls the halogen heater based on the output of the temperature detector, thereby maintaining the temperature of the surface of the fixing roller at a certain temperature.

The fixing device as described above, employed typically in an electrophotographic image forming apparatus, fixes an unfixed toner image on a recording medium by applying heat and pressure to the recording medium as it passes between the fixing roller and the pressure roller, specifically, where the fixing roller and the pressure roller meet and press against each other, hereinafter called a fixing nip or simply nip.

One example of such a fixing device employed in image forming apparatuses such as copiers and printers is a so-called on-demand fixing device. A rise time of this type of fixing device is known to be short.

Various types of on-demand fixing devices have been proposed. One example of a known on-demand fixing device employs a tubular fixing film (endless film) serving as a fixing member, a pressure roller serving as a pressing member, and a heater such as a ceramic heater serving as a heating member. The heater is provided inside the tubular fixing film and pressed against an interior surface of the fixing film, thereby heating the fixing film. The fixing film contacts the pressure roller to form the nip where pressure and heat are applied to the unfixed toner image on the recording medium to fix the unfixed toner image onto the recording medium.

In order to prevent irregular fixation and paper jams in this type of fixing device, the tubular fixing film serving as the fixing member needs to be heated evenly as well as stably, and the recording medium needs to be conveyed stably. In order to do so, the fixing member needs to rotate at a constant speed.

To address such a difficulty, another example of the on-demand fixing device proposes to control the speed of rotation of the fixing film by obtaining the rpm of the fixing film using a reflective member and a reflection-type detector. An end portion of the tubular fixing film is provided with the reflective member and the reflection-type detector is provided opposite the reflection member to detect the reflective member, thereby detecting the rpm of the fixing film.

In this approach, however, due to scattered toner and undesirable adherence of toner to the surface of the reflective member over time, reflectivity of the reflective member deteriorates. As a result, the rotation speed of the fixing member cannot be detected accurately.

As described above, on-demand fixing devices employ the tubular fixing film serving as a fixing member which is pressed and heated by the heater from inside the fixing film. The fixing film and the pressure roller faun the nip where heat and pressure are applied to the unfixed toner image on the recording medium to fix the unfixed toner image onto the recording medium. Using a film member having a low heat capacity as a fixing member allows for prompt heating of the fixing member.

Although advantageous, there is a drawback in such on-demand fixing devices in that, because the heater is in constant contact with the pressing member, the pressure needs to be removed when replacing the heater or fixing a paper jam. Thus, a dedicated pressure cancellation mechanism is required. Further, because the heater is always pressed by the pressing member, the heater is easily damaged during transportation.

Still another related-art fixing device includes a fixing roller serving as a fixing member, a separation roller provided with a driving member, and a fixing belt wound around and looped between the fixing roller and the separation roller. The separation roller separates the recording medium from the fixing belt. According to this configuration, the fixing roller and the fixing belt are rotated reliably by detecting a torque of the driving member of the separation roller.

Although generally successful, the size of the fixing device tends to be large, thereby defeating the purpose of making an image forming apparatus as compact as possible.

In view of the above, a device having a simple configuration that reliably fixes an unfixed toner image for an extended period of time is required.

SUMMARY OF THE INVENTION

In view of the foregoing, in one illustrative embodiment of the present invention, a fixing device for fixing an unfixed toner image on a recording medium with heat and pressure includes a fixing member, a first heater, a first pressing member, a second heater, a temperature detector, and a determination unit. The fixing member includes a recording medium passing area inside the fixing member through which the recording medium passes. The first heater is disposed inside the fixing member to heat the fixing member. The first pressing member is disposed opposite the fixing member to press against and rotate the fixing member to define a fixing nip through which the recording medium bearing the unfixed toner image passes to fix the unfixed toner image. The second heater is disposed outside the recording medium passing area and inside the fixing member and heats the fixing member cyclically in a given cycle of heating. The temperature detector detects a change in temperature of the fixing member when the fixing member is cyclically heated by the second heater while the fixing device is in operation. The determination unit evaluates a condition of rotation of the fixing member based on a comparison between the cycle of heating by the second heater and the change in the temperature of the fixing member detected by the temperature detector.

In another illustrative embodiment of the present invention, an image forming apparatus includes an image forming unit to fault an unfixed toner image on a recording medium and a fixing device to fix the unfixed toner image on the recording medium with heat and pressure. The fixing device includes a fixing member, a first heater, a first pressing member, a second heater, a temperature detector, and a determination unit. The fixing member includes a recording medium passing area inside the fixing member through which the recording medium passes. The first heater is disposed inside the fixing member to heat the fixing member. The first pressing member is disposed opposite the fixing member to press against and rotate the fixing member to define a fixing nip through which the recording medium bearing the unfixed toner image passes to fix the unfixed toner image. The second heater is disposed outside the recording medium passing area and inside the fixing member and heats the fixing member cyclically in a given cycle of heating. The temperature detector detects a change in temperature of the fixing member when the fixing member is cyclically heated by the second heater while the fixing device is in operation. The determination unit evaluates a condition of rotation of the fixing member based on a comparison between the cycle of heating by the second heater and the change in the temperature of the fixing member detected by the temperature detector.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
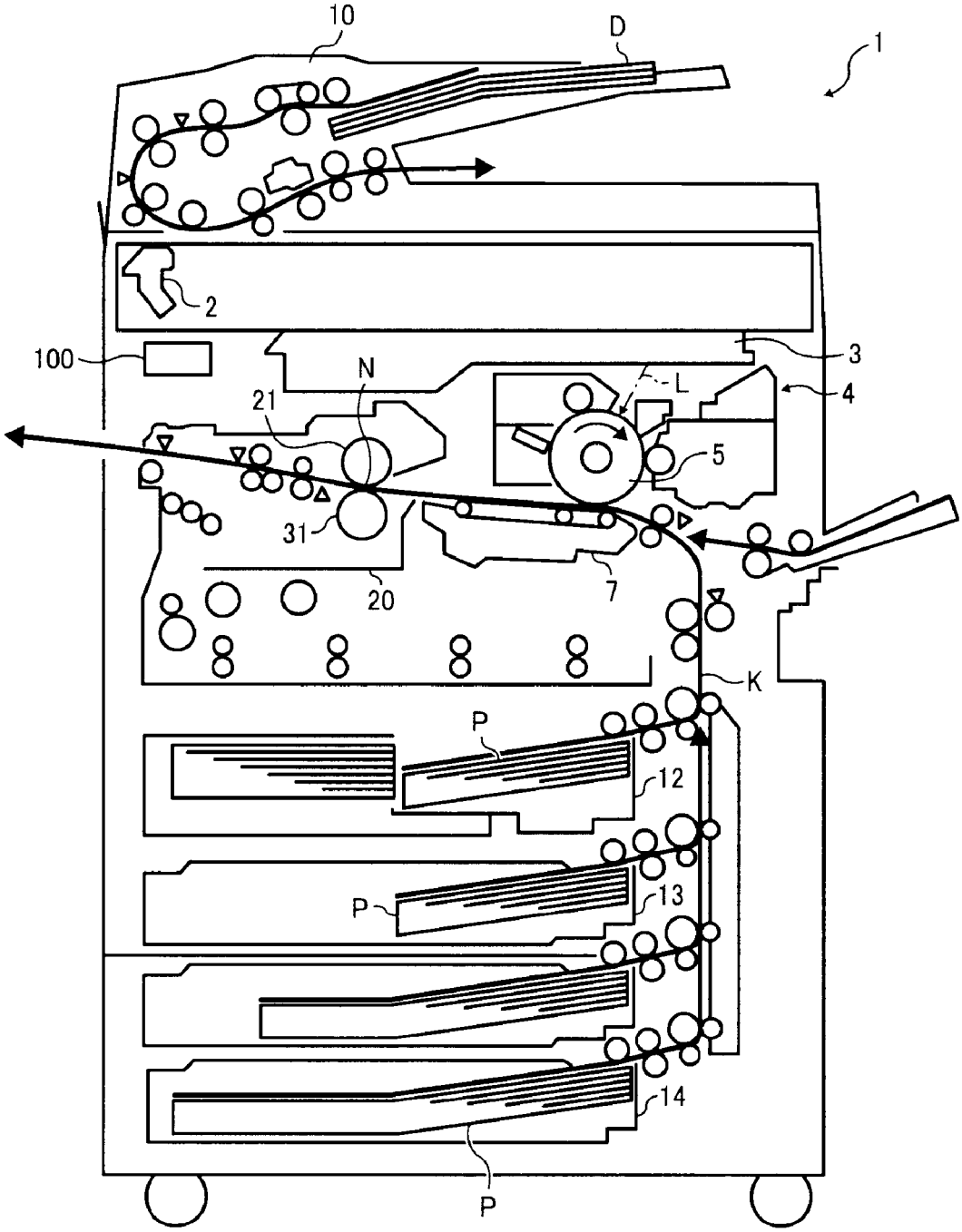
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to a first illustrative embodiment of the present invention is described.

FIG. 1 is a schematic diagram illustrating a copier as one example of the image forming apparatus according to the illustrative embodiment.

In FIG. 1, the image forming apparatus includes a copier main body 1, a document reader 2, an exposure unit 3, an image foaming unit 4, a photoreceptor drum 5, a transfer unit 7, a sheet conveyance unit 10, sheet cassettes 12, 13, and 14, and a fixing device 20.

The document reader 2 optically reads image information of a document D. The exposure unit 3 illuminates the photoreceptor drum 5 with exposure light L based on the image information read by the document reader 2. The image forming unit 4 includes the photoreceptor drum 5 and forms a toner image on the photoreceptor drum 5. The transfer unit 7 transfers the toner image formed on the photoreceptor drum 5 onto a recording medium P. The sheet conveyance unit 10 conveys the document D to the document reader 2. The sheet cassettes 12, 13, and 14 store multiple recording media sheets P. The fixing device 20 fixes an unfixed toner image on the recording medium P. The fixing device 20 includes a tubular fixing film 21 serving as a fixing member and a pressure roller 31 serving as a first pressing member.

With reference to FIG. 1, a description is now provided of a normal image forming operation.

The document D placed on a document table is conveyed in a direction of arrow and passes above the document reader 2. As the document D passes above the document reader 2, the image information of the document D is optically read by the document reader 2.

The image information optically read by the document reader 2 is converted to an electronic signal which is then provided to the exposure unit 3 serving also as an optical writing controller. The exposure unit 3 projects the exposure light L against the photoreceptor drum 5 of the image forming unit 4 based on the electronic signal of the image information.

In the image forming unit 4, the photoreceptor drum 5 is rotated in a clockwise direction. An electrostatic latent image on the photoreceptor drum 5 is developed through image forming processing including charging processing, exposure processing, and developing processing. Accordingly, the toner image is formed on the photoreceptor drum 5 in accordance with the image information.

Subsequently, the toner image formed on the photoreceptor drum 5 is transferred onto the recording medium P being conveyed in the transfer unit 7.

The recording medium P is conveyed in the image forming apparatus as follows. One of the sheet cassettes 12, 13, and 14 of the main body 1 is selected automatically or manually. For example, when the sheet cassette 12 at the top is selected, the top sheet of the recording media sheets P in the sheet cassette 12 is conveyed to a sheet conveyance path K.

Subsequently, the recording medium P passes through the sheet conveyance path K and is conveyed to the transfer unit 7 in appropriate timing such that the recording medium P is aligned with the toner image formed on the photoreceptor drum 5. As the recording medium P is conveyed to the transfer unit 7, the toner image on the photoreceptor drum 5 is transferred onto the recording medium P in the transfer unit 7.

After the transfer processing, the recording medium P is conveyed to the fixing device 20 after passing through the transfer unit 7. When arriving at the fixing device 20, the recording medium P is sent to a nip N serving as a fixing nip where the fixing film 21 and the pressure roller 31 meet and press against each other. In the nip N, the toner image is fixed by heat from the fixing film 21 and pressure of the pressure roller 31.

After the toner image is fixed, the recording medium P exits from the nip N between the fixing film 21 and the pressure roller 31. Then, the recording medium P is discharged outside the main body 1.

Figure 2:
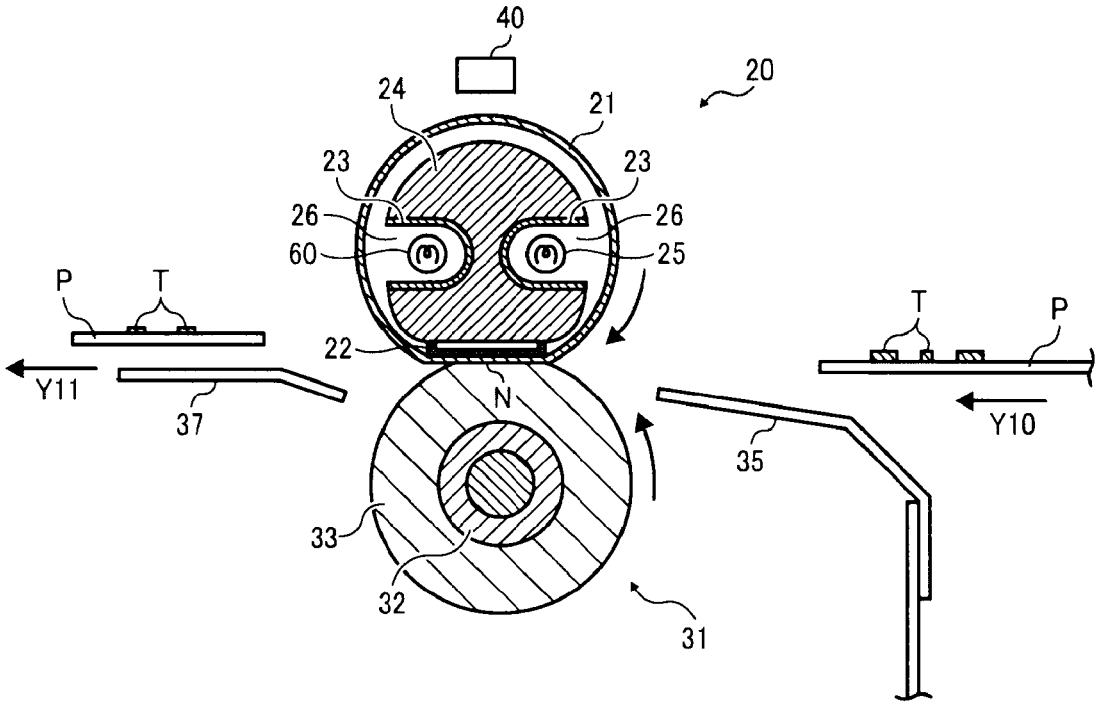
FIG. 2 is a cross-sectional schematic diagram illustrating a fixing device according to an illustrative embodiment of the present invention.
Figure 3:
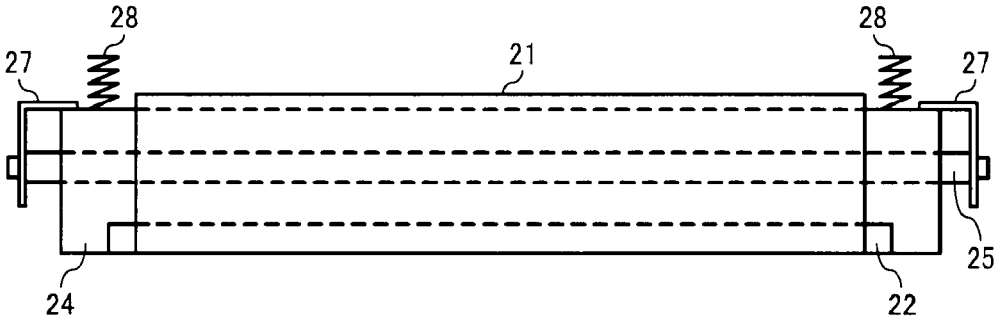
FIG. 3 is a side schematic view of a tubular fixing film serving as a fixing member according to an illustrative embodiment of the present invention.

With reference to FIGS. 2 and 3, a detailed description is provided of the fixing device 20 according to the illustrative embodiment. FIG. 2 is a cross-sectional schematic diagram illustrating the fixing device 20. FIG. 3 is a side view of the fixing film 21 serving as the fixing member.

As illustrated in FIG. 2, the fixing device 20 includes the fixing film 21 serving as the fixing member, a pressure pad 22 serving as a second pressing member, a reflection member 23 serving as a reflection member, a holding member 24, a first heater 25, the pressure roller 31, guide plates 35 and 37, a first temperature detector 40, a second temperature detector 41, a second heater 60, and so forth.

The holding member 24 is made of heat-resistant resin and holds the fixing film 21. The first heater 25 is an infrared heater and serves as a heating member. The guide plates 35 and 37 guide and convey the recording medium P. The first temperature detector 40 serves as a temperature detector that detects a temperature of the surface of the fixing film 21. The second temperature detector 41 serves as a dedicated temperature detector for detection of a thermal history of the fixing film 21. The second heater 60 is an infrared heater that serves as a dedicated heating member for heating the fixing film 21 for detecting the thermal history thereof.

The holding member 24 is configured to retain the shape of the fixing film 21. Since the fixing film 21 is made of a flexible material and has a substantially circular shape, the holding member 24 has a substantially circular shape in cross section to retain the circular shape of the fixing film 21 to some extent. With this configuration, deformation of the fixing film 21 can be prevented, thus preventing damage to the fixing film 21.

The pressure roller 31 is rotatably provided to a side plate of the fixing device 20, not illustrated, through a shaft bearing and driven by a drive motor, not illustrated, in a counterclockwise direction indicated by an arrow in FIG. 2. As the pressure roller 31 rotates, the fixing film 21 is rotated due to friction with the pressure roller 31, thereby enabling the fixing film 21 to rotate in the clockwise direction indicated by an arrow in FIG. 2.

The pressure roller 31 includes a metal core 32, the circumference of which is provided with an elastic layer 33. The elastic layer 33 is made of material such as fluoro rubber, silicone rubber, and foam silicone rubber. A thin release layer (tube) made of, for example, perfluoroalkoxy copolymer (PFA) resin, may be provided on the surface of the elastic layer 33.

Inside the interior of the fixing film 21, that is, inside the hollow of the fixing film 21, the first heater 25, the second heater 60, the pressure pad 22, the reflection member 23, the holding member 24, and so forth are disposed. The fixing film 21 is pressed against the pressure roller 31 by the pressure pad 22 from the inner circumferential side of the fixing film 21, thereby forming a nip N between the fixing film 21 and the pressure roller 31.

The guide plate 35 that guides the recording medium P to the nip N is disposed substantially at the beginning side of the nip N. The guide plate 37 that guides the recording medium P being discharged is disposed substantially at the end side of the nip N. Both the guide plate 35 and the guide plate 37 are fixed to a frame (housing) of the fixing device 20, not illustrated.

As illustrated in FIG. 2, the first heater 25 and the second heater 60 are disposed inside through-holes 26 formed at both sides of the holding member 24 facing each other. The through-holes 26 are formed along the longitudinal direction of the fixing film 21. The reflection member 23 is fixed to the inner circumference of the through-holes 26.

In FIG. 3, holders 27 are provided to the main body of the fixing device 20 to hold each end of the holding member 24. The fixing device 20 includes an urging member 28, which may be a compression spring or the like, that urges the fixing film 21 against the pressure roller 31 through the holding member 24.

An end portion of the first heater 25 is detachably fitted in a hole formed in the holder 27, not illustrated. Although not illustrated, the second heater 60 is held in the similar manner as the first heater 25.

The fixing film 21 is a thin flexible tubular film member that is endless. The fixing film 21 is rotated in the direction of arrow in FIG. 2. The material of the fixing film 21 includes, but is not limited to, polyimide resin, polyamide resin, fluoro resin, and a thin metal plate.

In order to secure good release properties (separability) with respect to toner T or the toner image, a release layer may be formed on the surface of the fixing film 21. Such a release layer may be made of perfluoroalkoxy copolymer resin (PFA), polyimide resin, polyetherimide resin, polyether sulfide (PES) and so forth. Using the fixing film 21 having a low heat capacity as a fixing member allows a significantly short rise time in the on-demand fixing device.

The pressure pad 22 is made of a thin metal plate with a thickness of approximately 0.1 mm. Alternatively, the pressure pad 22 may be a thin plate made of ceramic, polyimide resin, or any other suitable material. The pressure pad 22 and the pressure roller 31 meet and press against each other through the fixing film 21, thereby forming the nip N therebetween. The pressure pad 22 is fixedly supported by the fixing device 20.

The surface of the pressure pad 22 facing the pressure roller 31 has a substantially flat surface which makes the shape of the nip N facing the recording medium P substantially parallel with the image bearing surface of the recording medium P. With this configuration, the fixing film 21 can contact the recording medium P tightly, thereby enhancing fixing ability. Furthermore, the recording medium P passing through the nip N is prevented from getting curled or creased. Still further, since the curvature of the fixing film 21 at the end side of the nip N increases, the recording medium P discharged from the nip N is separated easily from the fixing film 21.

According to the illustrative embodiment, the surface of the pressure pad 22 that slidably contacts the fixing film 21 is coated with diamond-like carbon (DLC), thereby reducing abrasion of the inner circumference surface of the fixing film 21 that slidably contacts the pressure pad 22. Alternatively, instead of using the DLC coating, a PFA sheet, which is a sheet woven in a net pattern using PFA fiber, may be disposed between the fixing film 21 and the pressure pad 22.

Figure 4:
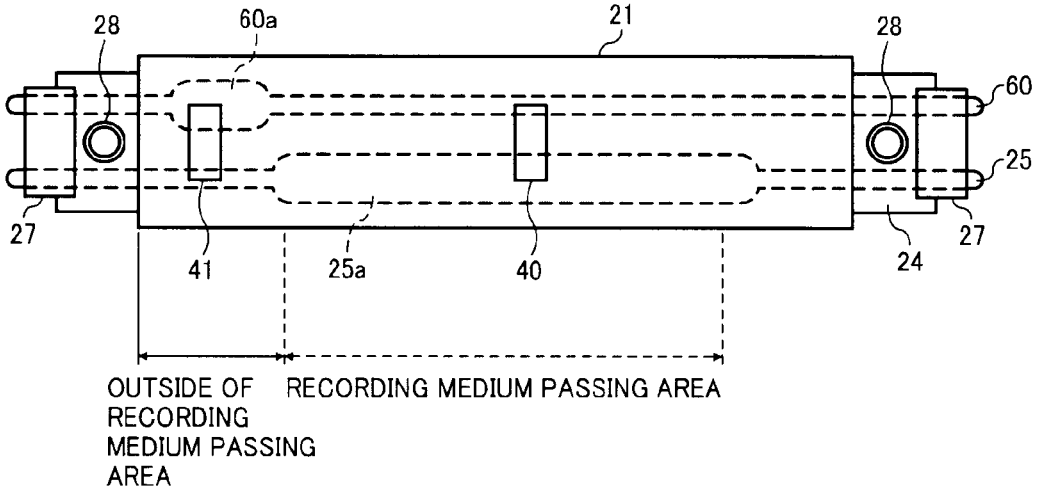
FIG. 4 is a schematic diagram illustrating relative positions of heaters and temperature detectors of the fixing device of FIG. 2.

With reference to FIG. 4, a description is now provided of the first and the second heaters 25 and 60 and the first and the second temperature detectors 40 and 41, according to the illustrative embodiment. FIG. 4 is a schematic diagram illustrating relative positions of the first heater 25, the second heater 60, the first temperature detector 40, and the second temperature detector 41.

The first heater 25 consists of a carbon heater or a halogen heater. Both ends of the first heater 25 are fixed to the side plates of the fixing device 20 through the holding member 24. The pressure pad 22 is heated by the first heater 25 controlled by a power source of the image forming apparatus. Subsequently, the pressure pad 22 heats the fixing film 21 which then heats the toner image T on the recording medium P.

The output of the first heater 25 is controlled based on the surface temperature of the fixing film 21 detected by the first temperature detector 40 disposed within a recording medium passing area opposite the surface of the fixing film 21. A desired temperature of the fixing film 21, that is, the fixing temperature, is obtained by controlling the output of the first heater 25 as described above. The control of the first heater 25 is implemented by a control section of a processor such as a central processing unit (CPU) 100 employed in the image forming apparatus or the fixing device.

The second heater 60, similar to the first heater 25, may be a carbon heater or a halogen heater. Both ends of the second heater 60 are fixed to the side plates of the fixing device 20 through the holding member 24. As illustrated in FIG. 4, a heat radiation portion 60*a* of the second heater 60 is disposed outside the recording medium passing area. The fixing film 21 is directly heated by the second heater 60 controlled by the power source of the image forming apparatus. The second temperature detector 41 detects the surface of the fixing film 21.

Figure 5:
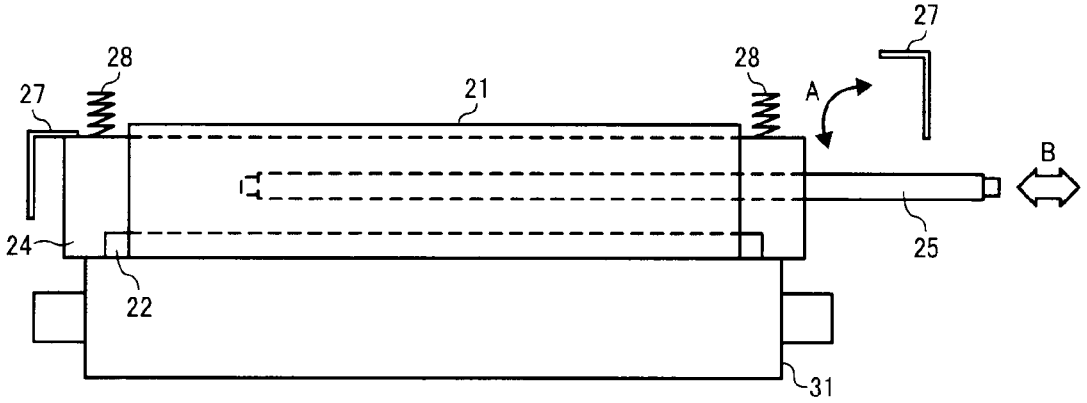
FIG. 5 is a schematic diagram illustrating removal of heaters of FIG. 4.

Referring now to FIG. 5, there is provided a schematic diagram illustrating removal of the first heater 25 and the second heater 60 from the fixing device 20.

According to the illustrative embodiment, as illustrated in FIG. 5, the first heater 25 is easily detached from the fixing device 20 while the pressure pad 22 contacts the pressure roller 31 through the fixing film 21.

When the first heater 25 needs to be removed from the fixing device 20, for example, there is a need for maintenance of the first heater 25, one of the holders 27 is detached from the holding member 24 by unfastening a screw, not illustrated, that fastens the holder 27 to the holding member 24. The holder 27 is removed from the holding member 24 in the direction indicated by a double-headed arrow A in FIG. 5.

Subsequently, the first heater 25 is pulled out from the through-hole 26 of the holding member 24 in the direction of arrow B from the same side from which the holder 27 is removed. A new heater or the fist heater 25 after maintenance is installed in the fixing device 20 in a reverse way.

Similar to the first heater 25, the second heater 60 is removed easily from the through-hole 26 of the holding member 24.

In such a configuration, the fixing device 20 has a short rise time, and replacement of the first and the second heaters 25 and 60 is easily done with a simple structure as described above. That is, replacement can be performed without releasing pressure of the pressure pad 22 as well as between the fixing film 21 and the pressure roller 31, requiring no dedicated structure that releases the pressure and thus facilitating replacement and maintenance of the heater 25.

Referring back to FIG. 2, both the first heater 25 and the second heater 60 are disposed in the through-holes 26, spaced from the fixing film 21 and the reflection member 23. In other words, there is a certain gap between the first heater 25 and the second heater 60, on the one hand, and the fixing film 21 and the reflection member 23 on the other. This configuration prevents the first heater 25 and the second heater 60 from being directly affected by vibration of the fixing film 21, the reflection member 23, and so forth, when transporting the fixing device 20 including the pressure pad 22 contacting the pressure roller 31 through the fixing film 21. Accordingly, the first heater 25 and the second heater 60 are prevented from suffering damage.

Furthermore, even when paper jams occur in the fixing device 20 and the jammed sheet needs to be removed while the pressure pad 22 is in contact with the pressure roller 31 through the fixing film 21, the first heater 25 and the second heater 60 are not directly affected by undesirable physical impact or vibration caused by the fixing film 21 and the reflection member 23, thereby also preventing damage to the first heater 25 and the second heater 60.

It is to be noted that using a carbon heater as the first heater 25 and the second heater 60 provides greater flexibility in on-off control compared with a halogen heater. In particular, even when the first heater 25 and the second heater 60 are turned on and off repeatedly before a duty of the first heater 25 and the second heater 60 reaches 100%, disconnection does not occur and degradation of output over time is thus reduced.

When using the carbon heater, it is preferable to configure the shape of the carbon heater such that an amount of radiant heat in the direction facing the fixing film 21 is greater than an amount of radiant heat in the direction perpendicular to the direction facing the fixing film 21. With this configuration, heat radiated from the first heater 25 and the second heater 60 is directed intensively to the fixing film 21, thereby heating the fixing film 21 efficiently.

With reference to FIGS. 6A through 6D, a description is provided of the structure of the reflection member 23 serving as a reflection member. FIGS. 6A through 6D are schematic diagrams illustrating examples of shapes of the reflection member 23 according to the illustrative embodiment.

The reflection member 23 is disposed opposite the portion of the fixing film 21 to be heated. In order to transmit as much heat received by the fixing film 21 as possible to the nip N before heat dissipates in the atmosphere, it is desirable to heat the portion of the fixing film 21 adjacent to the beginning of the nip N relative to the direction of rotation of the fixing film 21.

According to the illustrative embodiment, the base material of the reflection member 23 is glass. The interior of the reflective surface of the reflection member 23 is plated with metal or aluminum is evaporated onto the interior of the reflective surface.

Figure 6A:
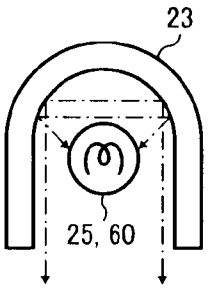
FIG. 6A through 6D are schematic diagrams illustrating examples of shapes of a reflection plate according to an illustrative embodiment of the present invention.
Figure 6B:
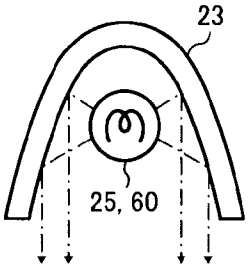
Figure 6C:
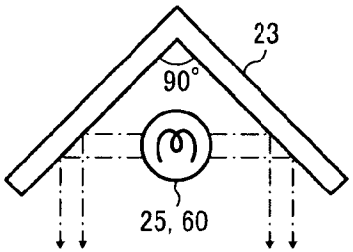
Figure 6D:
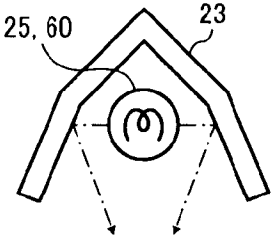

The reflection member 23 extends along an axial direction or a longitudinal direction of the first heater 25 and the second heater 60. As illustrated in FIGS. 6A through 6D, insofar as one side of the reflection member 23 is opened, the reflection member 23 is not limited to a substantially circular-arc shape as illustrated in FIGS. 6A and 6B. The reflection member 23 may have a square shape such as shown in FIGS. 6C and 6D.

When the reflection member 23 has a shape of quadratic curve such as shown in FIGS. 6A and 6B, the first heater 25 and the second heater 60 are disposed at a focal point of the quadratic curve so that heat can be transmitted to the fixing film 21 by a single reflection.

As mentioned, the reflection member 23 may have a shape such as shown in FIGS. 6C and 6D. In particular, when the first heater 25 and the second heater 60 have a luminous distribution, preferably, an angle of an angular portion of the reflection member 23 is 90 degrees as shown in FIGS. 6C, for example, and the first heater 25 and the second heater 60 are disposed such that the normal line in the direction of luminous distribution of the heaters bisects the angle of the reflection member 23. With this configuration, light is reflected evenly at both sides of the heaters.

An absorption member that absorbs infrared light may be provided to the interior of the fixing film 21, that is, the surface facing the first heater 25 and the second heater 60. In particular, the inner surface of the fixing film 21 is coated with black coating. With this configuration, absorption of the infrared light in the fixing film 21 is enhanced, thereby increasing a heating efficiency of the fixing film 21.

As illustrated in FIG. 2, the first heater 25 is disposed upstream of the pressure pad 22 in the direction of rotation and directly heats the fixing film 21. This configuration can provide a desirable temperature gradient in the nip N defined together with the pressure pad 22 so that good cooling efficiency of toner is achieved at the downstream of the nip N, resulting in high glossiness in the toner image after the fixing process.

Figure 7A:
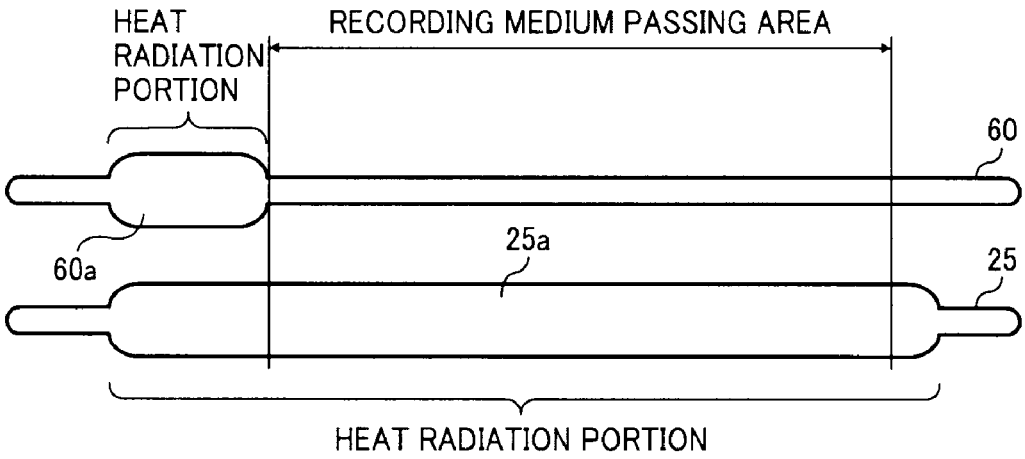
FIG. 7A and 7B are schematic diagrams illustrating heat radiation portions of the heaters according to an illustrative embodiment of the present invention.
Figure 7B:
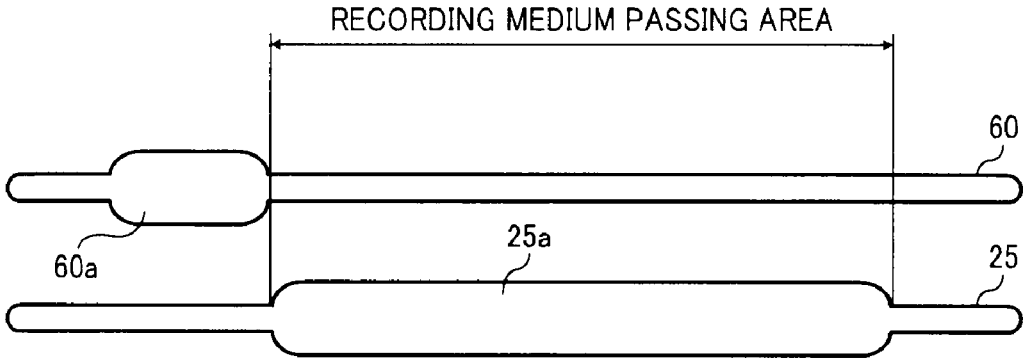

With reference to FIGS. 7A and 7B, a description is now provided of the heat radiation portions of the first heater 25 and the second heater 60. FIGS. 7A and 7B are schematic diagrams illustrating the heat radiation portions 25*a* and 60*a* of the first heater 25 and the second heater 60, respectively.

As illustrated in FIGS. 7A and 7B, the heat radiation portion 60*a* of the second heater 60 is disposed outside the recording medium passing area. It is desirable to dispose the heat radiation portion 25*a* of the first heater 25 within the recording medium passing area as illustrated in FIG. 7B. However, as illustrated in FIG. 7A, the heat radiation portion 25*a* may extend beyond the recording medium passing area.

Referring back to FIG. 4, the first temperature detector 40 is disposed substantially at the center of the fixing film 21 in the longitudinal direction. The second temperature detector 41 is disposed at one end of the fixing film 21. The surface temperature of the fixing film 21 is detected by the first temperature detector 40 and the second temperature detector 41.

With reference to FIG. 2, a description is provided of detection and control of the temperature of the surface of the fixing film 21 according to the illustrative embodiment.

When power of the main body 1 of the image forming apparatus is turned on, power is supplied to the first heater 25 and rotation of the pressure roller 31 in the direction of arrow is initiated. Due to friction with the pressure roller 31, the fixing film 21 is rotated in the direction of arrow.

Subsequently, the recording medium P bearing an unfixed image (hereinafter referred to as toner image T) is guided to the nip N between the fixing film 21 and the pressure roller 31 by the guide plate 35 in the direction of arrow Y10. Heat and pressure are applied to the recording medium P in the nip N, thereby fixing the toner image T on the recording medium P. Then, the recording medium P is discharged from the nip N and is conveyed in the direction of arrow Y11.

As illustrated in FIGS. 4 and 7, the second temperature detector 41 and the heat radiation portion 60*a* of the second heater 60 are disposed outside the recording medium passing area. By contrast, the first temperature detector 40 and the heat radiation portion 25*a* of the first heater 25 are disposed within the recording medium passing area.

Figure 8A:
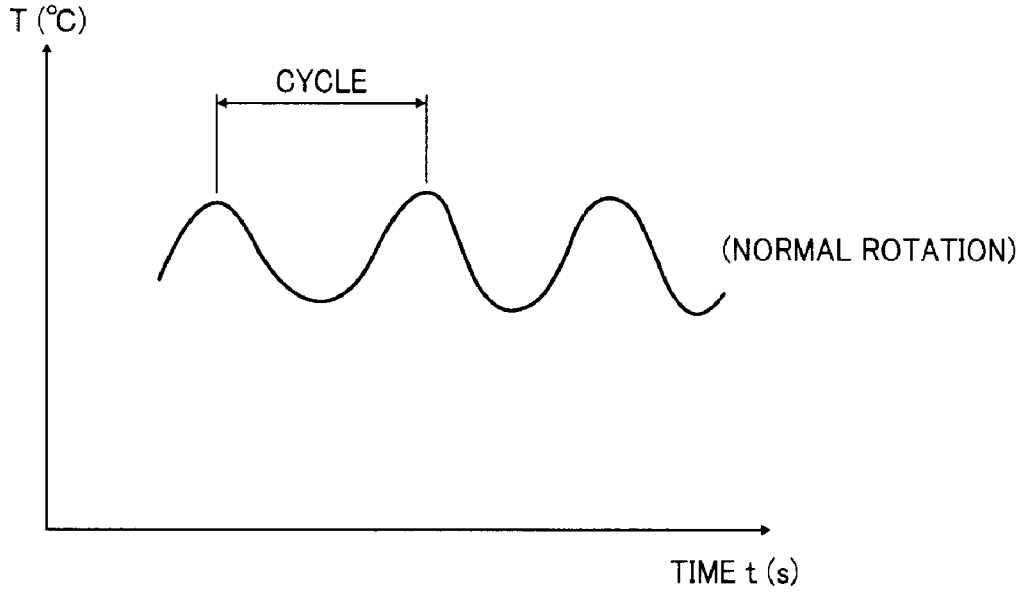
FIG. 8A and 8B are charts schematically illustrating fluctuation of the temperature of the fixing film when heated periodically.
Figure 8B:
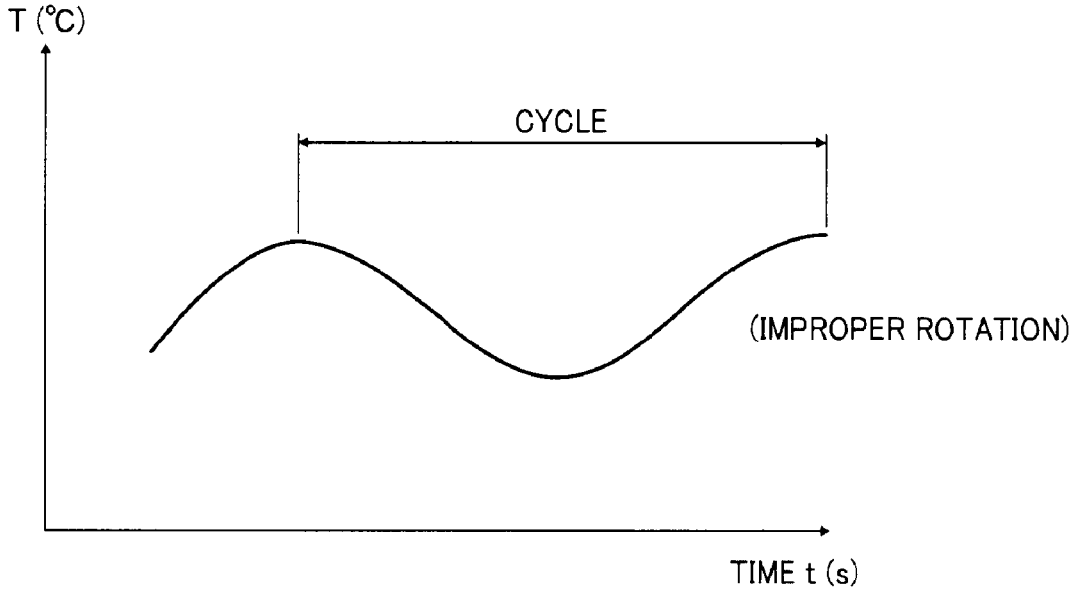

With reference to FIGS. 8A and 8B, a description is provided of detection of rotation of the fixing film 21 according to the illustrative embodiment. FIGS. 8A and 8B are charts schematically illustrating fluctuation of the temperature of the fixing film 21 when heated periodically. In FIGS. 8A and 8B, a vertical axis represents a temperature detected by the second temperature detector 41, and a horizontal axis represents a time.

According to the illustrative embodiment, the second heater 60 is turned on and off or flashed periodically during operation of the fixing device 20. That is, the fixing film 21 is heated and not heated periodically, causing the temperature of the fixing film 21 to fluctuate periodically as illustrated in FIG. 8A.

When the second heater 60 is turned on and off, the second temperature detector 41 detects the change in the temperature of the fixing film 21, that is, the thermal history of the fixing film 21. In order to determine a condition of rotation of the fixing film 21, a determination section of the processor such as the CPU 100 serving as a determination unit of the image forming apparatus or the fixing device compares a cycle of change in the temperature of the fixing film 21 and the on-off cycle of the second heater 60 based on the temperature of the fixing film 21 detected by the second temperature detector 41.

In other words, when the on-off cycle of heating of the second heater 60 coincides with the temperature change in the fixing film 21 detected by the second temperature detector 41, it is determined that the fixing film 21 is rotated at a certain speed.

By contrast, if the fixing film 21 is rotated improperly, for example, the fixing film 21 skids, there is a difference between the duration of the on-off cycle of the second heater 60 and the duration of the cycle of change in the temperature of the fixing film 21 as illustrated in FIG. 8B. Consequently, it is possible to determine that there is a problem with rotation of the fixing film 21 such as skidding.

In such a case, when the difference between the on-off cycle of the second heater 60 and the cycle of change in the temperature of the fixing film 21 is significant, for example, the difference therebetween exceeds a preset reference value, stopping the fixing operation can prevent a fixing error and a sheet conveyance failure by providing respective devices with a stop signal to stop the fixing operation from the determination section of the CPU 100.

It is to be noted that the determination section of the CPU 100 may calculate the rotation speed of the fixing film 21 based on the cycle of change in the temperature detected by the second temperature detector 41. In such a case, the change in the rotation speed of the fixing film 21 can be obtained based on the change in the cycle of change in the temperature, and the control with respect to the reference rotation speed can be implemented.

In this configuration, if the rotation speed of the fixing film 21 changes significantly, stopping the fixing operation can prevent a fixing error and a sheet conveyance failure by providing the respective devices with the stop signal to stop the fixing process from the processing unit such as the CPU 100.

Figure 9:
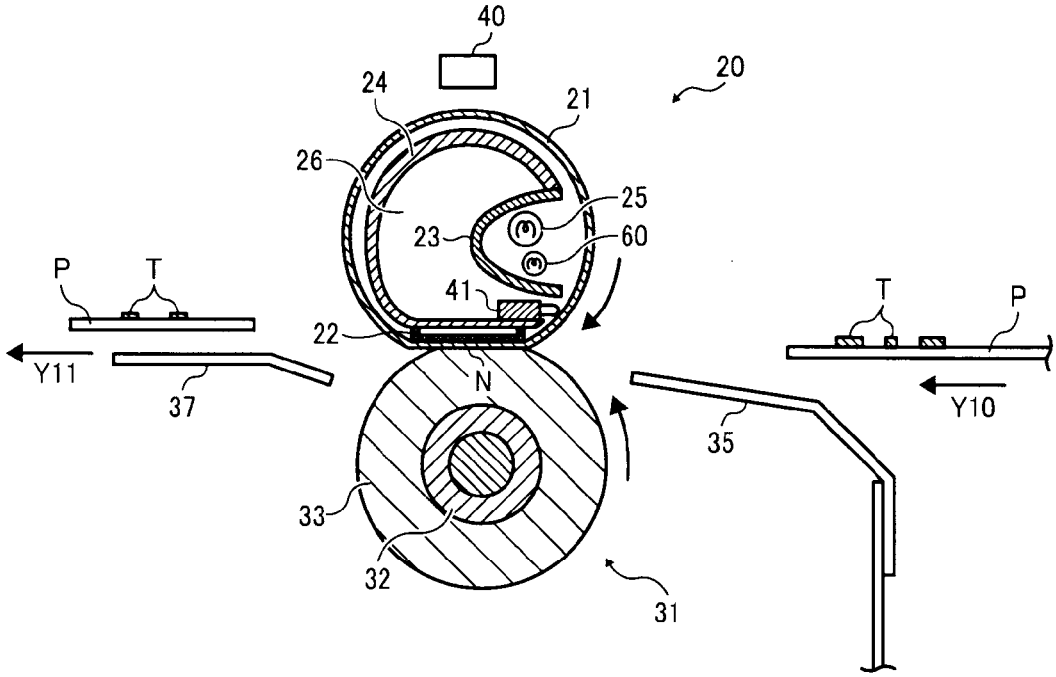
FIG. 9 is a cross-sectional schematic diagram illustrating the fixing device of another illustrative embodiment of the present invention.
Figure 10:
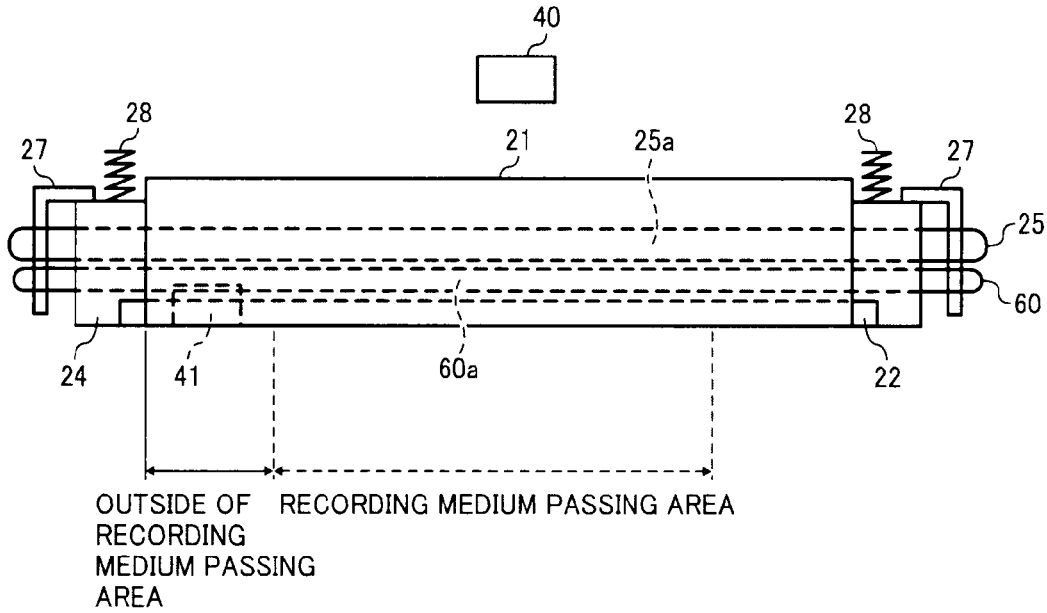
FIG. 10 is a diagram showing relative positions of heaters and temperature detectors of the fixing device of FIG. 9.

With reference to FIGS. 9 and 10, a description is provided of the fixing device according to another illustrative embodiment. FIG. 9 is a cross-sectional schematic diagram illustrating the fixing device of another illustrative embodiment. FIG. 10 is a side schematic view of the respective fixing device. It is to be noted that the same reference numerals used in FIGS. 1 through 8 are provided to parts and materials having the same functions, and redundant descriptions thereof are omitted.

As will be later described in detail, compared with the first illustrative embodiment, the position of the first heater 25, the second heater 60, the first temperature detector 40, and the second temperature detector 41 is different. Further, there is one through-hole 26, and the shape of the holding member 24 is also different.

According to the present embodiment, both the first heater 25 and the second heater 60 are disposed in the interior of the reflection member 23 which is fixed to one side of the through-hole 26 of the holding member 24. The second temperature detector 41 is disposed substantially between the second heater 60 and the nip N in the through-hole 26 of the holding member 24 inside the hollow of the fixing film 21. The holding member 24 of the present embodiment is formed such that a metal sheet is molded into a bent shape to have one opening. Alternatively, the holding member 24 may be formed of a resin mold or curved-mould aluminum.

A contact-type detector is used as the second temperature detector 41. In this case, a detector element of the second temperature detector 41 is covered with a fluoro resin tape made of polytetrafluoroethylene (PTFE) resin, PFA resin, or the like.

As illustrated in FIG. 10, similar to the first illustrative embodiment, the second temperature detector 41 associated with the second heater 60 is disposed outside the recording medium passing area, and the first temperature detector 40 associated with the first heater 25 is disposed within the recording medium passing area.

According to the present embodiment, the condition of rotation of the fixing film 21 is determined in a manner similar to the first illustrative embodiment.

The foregoing description pertains to a fixing device that employs a pressure roller as a pressing member. However, the pressing member is not limited to a roller. The present invention may be applied to a fixing device that employs a belt-type or a pad-type pressing member. In either cases, the same effect as that of the illustrative embodiments can be achieved as well.

Furthermore, according to the illustrative embodiments, the present invention is applied to a fixing device for fixing an unfixed image, also known as a toner image. The present invention may be applied to a fixing device employed in an image forming apparatus including, but not limited to, a copier, a printer, a facsimile machine, and a multi-functional system. Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing an unfixed toner image on a recording medium with heat and pressure, comprising:

a fixing member including a recording medium passing area inside the fixing member through which the recording medium passes;

a first heater disposed inside the fixing member, to heat the fixing member;

a first pressing member disposed opposite the fixing member to press against and rotate the fixing member to define a fixing nip through which the recording medium bearing the unfixed toner image passes to fix the unfixed toner image;

a second heater disposed outside the recording medium passing area and inside the fixing member, to heat a uniform region of the fixing member cyclically in a given cycle of heating such that a temperature of the second heater is increased and decreased cyclically which heats the fixing member cyclically;

a temperature detector to detect a change in temperature of the fixing member when the fixing member is cyclically heated by the second heater while the fixing device is in operation; and a determination unit to evaluate a condition of rotation of the fixing member based on a comparison between the cycle of heating by the second heater and the change in the temperature of the fixing member detected by the temperature detector.

2. The fixing device according to claim 1, wherein the fixing member includes a substantially cylindrical hollow film member and a holding member disposed inside the film member to hold the fixing member in place in the fixing device.

3. The fixing device according to claim 1, wherein the fixing member includes a second pressing member inside the fixing member, to press and contact the fixing member against the first pressing member.

4. The fixing device according to claim 1, wherein the fixing member includes a through-hole in the fixing member extending in a longitudinal direction thereof, and the first heater and the second heater are accommodated in the through-hole.

5. The fixing device according to claim 4, wherein a reflection member is provided inside the through-hole to reflect heat from the first heater and the second heater in directions determined by a shape of the reflection member.

6. The fixing device according to claim 1, wherein the fixing member includes a plurality of through-holes in the fixing member extending in a longitudinal direction thereof, and the first heater and the second heater are each accommodated in one of the holes.

7. The fixing device according to claim 6, wherein a reflection member is provided inside each of the through-holes to reflect heat from the first heater and the second heater in directions determined by a shape of the reflection member.

8. The fixing device according to claim 1, wherein the temperature detector is disposed between the second heater and the fixing nip.

9. The fixing device according to claim 1, wherein the temperature detector is disposed inside the fixing member.

10. The fixing device according to claim 1, wherein the determination unit outputs a signal that stops fixing operation when a difference between the cycle of heating by the second heater and the cycle of change in the temperature of the fixing member detected by the temperature detector exceeds a maximum permissible range.

11. An image forming apparatus, comprising:

an image forming unit to form an unfixed toner image on a recording medium; and a fixing device to fix the unfixed toner image on the recording medium with heat and pressure, the fixing device including a fixing member including a recording medium passing area inside the fixing member corresponding to an area through which the recording medium passes;

a first heater disposed inside the fixing member, to heat the fixing member;

a first pressing member disposed opposite the fixing member to press against and rotate the fixing member to define a fixing nip through which the recording medium bearing the unfixed toner image passes to fix the unfixed toner image;

a second heater disposed outside the recording medium passing area and inside the fixing member, to heat a uniform region of the fixing member cyclically in a given cycle of heating such that a temperature of the second heater is increased and decreased cyclically which heats the fixing member cyclically a temperature detector to detect a change in temperature of the fixing member when the fixing member is cyclically heated by the second heater while the fixing device is in operation; and a determination unit to evaluate a condition of rotation of the fixing member based a comparison between the cycle of heating operation of the second heater and a cycle of change in the temperature of the fixing member detected by the temperature detector.

12. The image forming apparatus according to claim 11, further comprising:

a second temperature detector, disposed outside the recording medium passing area, for detecting a thermal history of the fixing member, wherein the determination unit performs said comparison using the second temperature detector.

13. The fixing device according to claim 1, further comprising:

a second temperature detector, disposed outside the recording medium passing area, for detecting a thermal history of the fixing member, wherein the determination unit performs said comparison using the second temperature detector.

* * * * *